United States Patent [19]

Peschmann

[11] 4,253,024

[45] Feb. 24, 1981

[54] RADIATION DETECTION DEVICE

[75] Inventor: Kristian Peschmann, Aachen, Fed. Rep. of Germany

[73] Assignee: U.S. Philips Corporation, New York, N.Y.

[21] Appl. No.: 953,327

[22] Filed: Oct. 20, 1978

[30] Foreign Application Priority Data

Oct. 26, 1977 [DE] Fed. Rep. of Germany ..... 2747872

[51] Int. Cl.[1] ..... G01T 1/18

[52] U.S. Cl. ..... 250/374; 250/385

[58] Field of Search ..... 250/374, 375, 385; 313/93

[56] References Cited

U.S. PATENT DOCUMENTS

| | | | |
|---|---|---|---|
| 2,837,678 | 6/1958 | Hendee et al. | 313/93 |
| 3,609,435 | 9/1971 | Taylor et al. | 250/385 |
| 3,784,951 | 1/1974 | Steidel | 338/262 |
| 3,934,165 | 1/1976 | Meekins | 250/374 |

*Primary Examiner*—Alfred E. Smith
*Assistant Examiner*—Janice A. Howell
*Attorney, Agent, or Firm*—Marc D. Schechter

[57] ABSTRACT

A radiation detection device comprising a housing which comprises an entrance window and in which at least one ionization chamber detector is arranged. The detector comprises a flat high-voltage electrode which is directed transverse to the entrance window and a flat collector electrode which is arranged to be at least substantially parallel to the high-voltage electrode. The end faces of these electrodes which face the entrance window are in electrical contact with a flat auxiliary electrode which extends parallel to the entrance window. As a result, a small direct current flows in a direction transverse to the other electrodes during operation, because the auxiliary electrode has a low electrical conductivity. Consequently, the electrical field in the ionization chamber detector is very homogeneous, with the result that the measuring speed can be optimized.

6 Claims, 3 Drawing Figures

RADIATION DETECTION DEVICE

BACKGROUND OF THE INVENTION

The invention relates to a radiation detection device, comprising a housing which comprises an entrance window and in which there is arranged at least one ionization chamber detector which comprises a flat high-voltage electrode which is directed transverse to the entrance window and a flat collector electrode which is arranged to be substantially parallel to the high voltage electrode. The collector electrode has an end face which faces the entrance window and which is electrically connected to a contact face which is situated opposite the end face and which forms part of a flat auxiliary electrode which extends parallel to the entrance window.

A radiation detection device of this kind is particularly suitable for use in a computer tomography apparatus in which a body is irradiated from a large number of directions by means of a fan-shaped radiation beam. A radiation detection device comprising a large number of detectors serves to measure the radiation absorption of the body along a large number of radiation paths. On the basis of the measured data, the density distribution of the irradiated part of the body is calculated and displayed on, for example, a television monitor by means of a computer.

German Patent Application No. 29.09.626 (which corresponds to U.S. Patent application Ser. No. 774,135, filed Mar. 3, 1977, now abandoned) discloses a radiation detection device of the described kind in which the auxiliary electrode is made of an electrically conductive material extending to the vicinity of the high-voltage electrode without electrically contacting it. This auxiliary electrode intercepts charge carriers formed by ionization which, in the case of a detector without such an auxiliary electrode, would be incident on the entrance window instead of on the collector electrode so that they would not contribute to a detector output signal. Because the auxiliary electrode is electrically connected to the collector electrode, the charge carriers intercepted by the collector electrode do contribute to the detector output signal. As a result, the detection efficiency of the detector is high in comparison with a detector which does not include such an auxiliary electrode. Radiation which enters the detector via the entrance window produces a comparatively large number of charge carriers in the immediate vicinity of the entrance window, because the intensity of the radiation, and the associated number of ionizations caused thereby, exponentially decreases as a function of the distance from the entrance window in the direction transverse to the window.

In the known detector, the distance between the auxiliary electrode and the high-voltage electrode is smaller than the distance between the collector electrode and the high-voltage electrode. As a result, after application of a high voltage between the electrodes, the electric field arising between the auxiliary electrode and the high-voltage electrode will be larger than the electrical field arising between the collector electrode and the high-voltage electrode. The electric field in the detector thus exhibits a spatial inhomogeneity, with the result that the detector is comparatively slow, because the measuring speed, being proportional to the drift speed of charge carriers formed by ionization, is limited in the case of high electric field strengths by space charges caused by avalanches of secondary ionizations and in the case of low electric field strengths by the value of the field strength.

SUMMARY OF THE INVENTION

An object of the invention is to provide a radiation detection device which offers a high detection efficiency and in which the drawback relating to low measuring speed is mitigated. To this end, a radiation detection device according to the invention is characterized in that the auxiliary electrode has a comparatively high electrical resistance measured in the direction transverse to the collector electrode, and a second contact face of the auxiliary electrode is situated opposite an end face of the high-voltage electrode facing the entrance window and is electrically connected to the high-voltage electrode.

During operation of the detector, a comparatively small direct current flows from the high-voltage electrode through the auxiliary electrode to the collector electrode with the result that the voltage difference between a point on the auxiliary electrode and the collector electrode linearly increases with the distance between the point and the collector electrode. The electric field between the high-voltage electrode and the collector electrode is thus homogeneous in the vicinity of the auxiliary electrode. Since the electric field in the ionization chamber will be as homogeneous as described above whether the contact faces of the auxiliary electrode are electrically connected across a potential which equals the difference between high-voltage electrode potential and the collector electrode potential, or whether the contact faces are situated on the side of the auxiliary electrode facing the electrodes or on the side of the auxiliary electrode facing the entrance window, the meaning of "electrically connected to a contact face" should be construed broadly. When the electric field is chosen to be so large that avalanches of secondary ionizations are just precluded, the optimum measuring speed is reached.

A preferred embodiment of the radiation detection device according to the invention is characterized in that the collector electrode consists of an electrically conductive layer on a flat side of an electrically insulating support. The conductive layer functions to intercept charge carriers formed by ionizations in the detector. An end face of the support is provided with a grounded metal strip which is electrically connected to the first contact face of the auxiliary electrode while being insulated from the collector electrode.

Because the collector electrode of an ionization chamber detector is, on the average, at ground least substantially at potential during operation, the electric field between the high-voltage electrode and the collector electrode is also homogeneous in the vicinity of the auxiliary electrode in this preferred embodiment of the radiation detection device. Because, moreover, the signal current generated between the electrodes by ionization during operation and the direct current through the auxiliary electrode are isolated from each other, noise on the direct current through the auxiliary electrode, having a high resistance, cannot have an adverse effect on the signal current.

A very simple radiation detection device according to the invention is characterized in that the auxiliary electrode is formed by a resistance layer which directly contacts the end face of the collector electrode and the end face of the high-voltage electrode.

When the auxiliary electrode is brought into direct contact with the end faces, moreover, vibrations of the high-voltage electrode with respect to the collector electrode during operation are attenuated.

The invention will be described in detail hereinafter, by way of example, with reference to the accompanying drawings.

DESCRIPTION OF THE PREFERRED EMBODIMENTS

Figure 1:
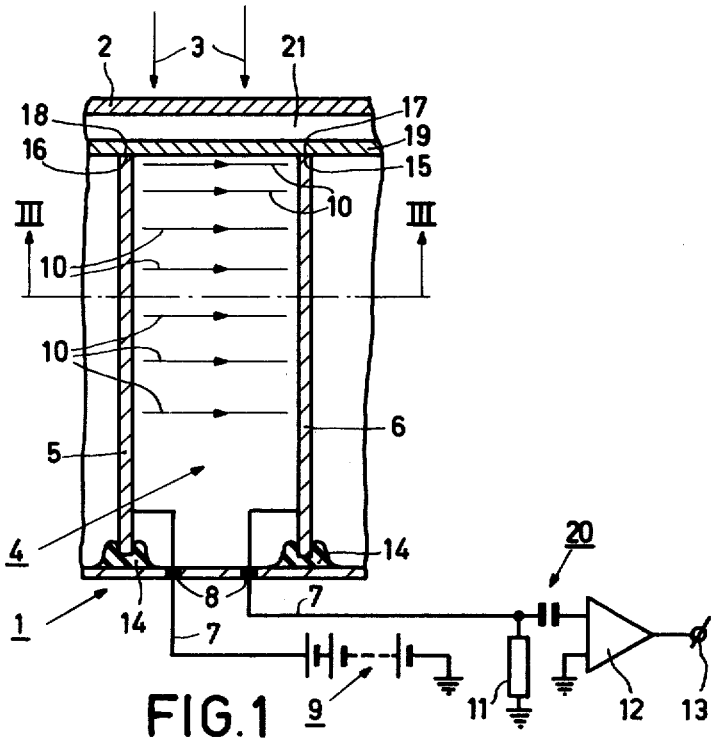
FIG. 1 is a sectional view of a radiation detection device according to the invention.

FIG. 1 is a sectional view of a radiation detection device according to the invention, comprising a housing 1 which is provided with an entrance window 2 through which radiation to be detected, diagrammatically denoted by arrows 3, can enter the housing. In the housing 1 there is arranged an ionization chamber detector 4 which comprises a flat high-voltage electrode 5, directed transverse to the entrance window 2, and a flat collector electrode 6 which is arranged to be parallel to high-voltage electrode 5. Via connection wires 7, passed through electrically insulated passages 8 in the housing, a high-voltage source 9 can be connected between the high-voltage electrode 5 and the collector electrode 6. The source generates an homogeneous electrical field, diagrammatically denoted by arrows 10, in the ionization chamber 4. The ionization chamber detector 4 is filled with a medium which can be ionized, for example Xe-gas, and in which free charge carriers are formed by the incident radiation by ionization. In the ionization chamber detector 4 these charge carriers cause an electrical current which causes a voltage difference across a resistor 11, the difference being applied to an amplifier 12 in order to generate a detector output signal which can be taken from the output 13 of the amplifier 12. Resistor 11 and amplifier 12 are an example of one type of current measuring means.

The high-voltage electrode 5 and the collector electrode 6 are secured in the housing by means of insulating holders 14. End faces 15 and 16, facing the entrance window 2, of the collector electrode 6 and the high-voltage electrode 5, respectively, are electrically connected in direct contact to contact faces 17 and 18, situated opposite the end faces 15 and 16, of a flat auxiliary electrode 19 which extends parallel to the entrance window 2.

The auxiliary electrode 19 consists of an homogeneous resistance layer and exhibits, measured in the direction transverse to the collector electrode 6, a comparatively high electrical resistance of, for example, $10^8$ to $10^{11}$ ohms per cm. As a result, during operation of the detector, a comparatively small direct current flows from the high-voltage electrode 5 to the collector electrode 6, this current causing the voltage difference between a point on the auxiliary electrode 19 and the collector electrode 6 to increase linearly with the distance between this point and the collector electrode 6. The electric field between the high-voltage electrode 5 and the collector electrode 6 is thus homogeneous in the vicinity of the auxiliary electrode 19. This field is then adjusted to be so large that avalanches of secondary ionizations in the ionization chamber detector is just precluded. As a result, the optimum measuring speed is reached. In order to isolate the direct current through the auxiliary electrode 19 from the signal current which is generated by the free charge carriers formed during the ionizations and which consequently, varies pulse-like in time, the voltage difference appearing across the resistor 11 due to the two currents is applied, via a capacitor 20, to the amplifier 12, with the result that the direct voltage component is blocked.

The space 21 between the entrance window 2 and the auxiliary electrode 19 and the thickness of the auxiliary electrode 19 are shown in exaggerated form in the drawing. These should be as small as possible because a comparatively large number of free charge carriers is formed in the immediate vicinity of the entrance window 2 by the incoming radiation 3 because the intensity of the radiation and the associated number of ionizations caused thereby decreases exponentially in the direction transverse to the entrance window 2.

Figure 2:
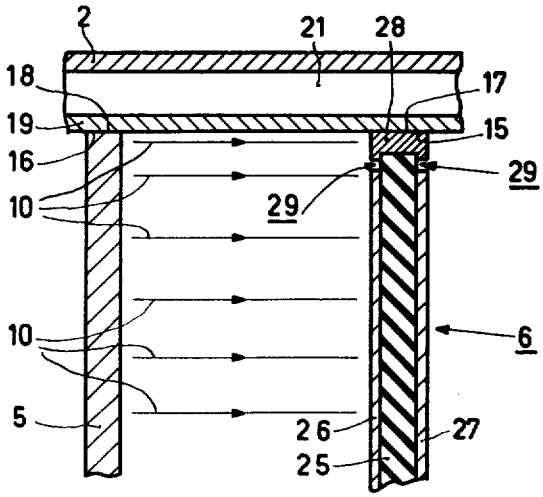
FIG. 2 is a sectional view of a preferred embodiment of a radiation detection device according to the invention.

FIG. 2 is a sectional view of a preferred embodiment of a radiation detection device according to the invention in which reference numerals corresponding to FIG. 1 are used for corresponding parts. The collector electrode 6 consists of a flat, electrically insulating support 25, a flat side of which is provided with an electrically conductive layer 26 for intercepting free charge carriers formed by ionization in the detector. The other flat side may also be provided with an electrically conductive layer 27 in order to intercept free charge carriers formed by ionizations in a neighboring detector. The end face 15 of the collector electrode 6 is formed by a metal strip 28 which is electrically connected to the contact face 17 of the auxiliary electrode 19 and which is insulated from the electrically conductive layers 26 and 27 by a space 29. The metal strip 28 is connected to ground potential in the same manner as the connection of the collector electrode 6 and the high-voltage electrode 5. Because the collector electrode 6 of the ionization chamber detector 4 is, on the average, substantially at ground potential during operation, in this preferred embodiment the electric field 10 is homogeneous in the vicinity of the auxiliary electrode 19. Because, moreover, the signal current generated by ionizations and the direct current through the auxiliary electrode are isolated from each other by the space 29, noise on the direct current cannot have an adverse effect on the signal current. Moreover, the capacitor 20 in the circuit shown in FIG. 1 can then be omitted.

Figure 3:
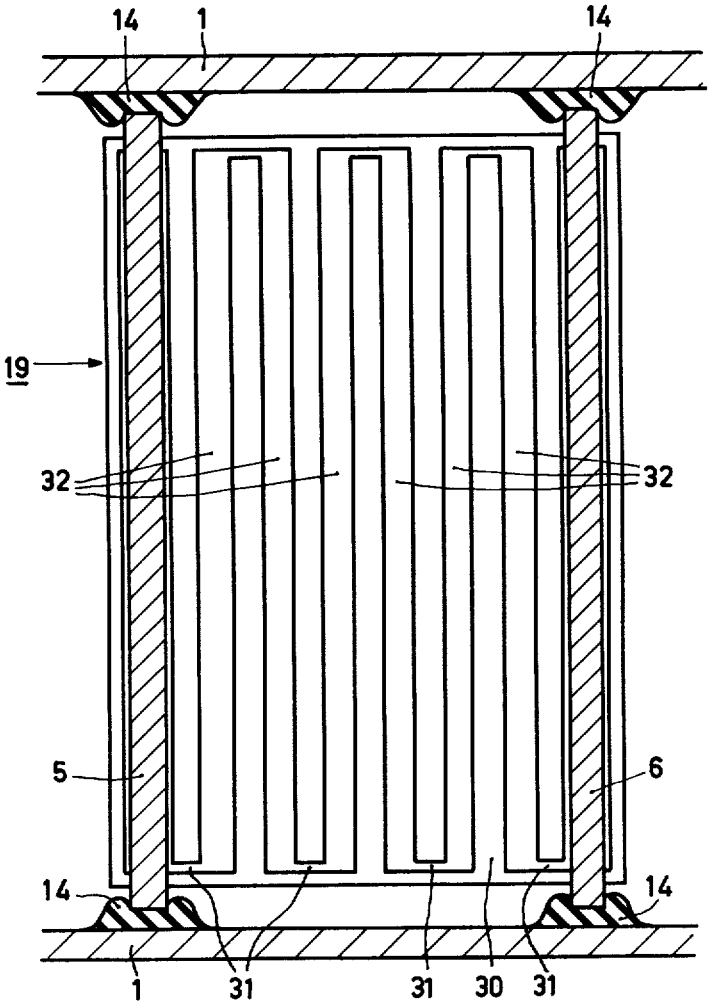
FIG. 3 is a cross-sectional view of a radiation detection device according to the invention, taken along the line III—III in FIG. 1, illustrating a special embodiment of the auxiliary electrode.

FIG. 3 is a cross-sectional view of a radiation detection device according to the invention taken along the line III—III in FIG. 1 illustrating a special embodiment of the auxiliary electrode 19. In FIG. 3, the reference numerals correspond to the same parts as in FIG. 1. The auxiliary electrode 19 consists of a flat, electrically insulating support 30 on which a meandered resistance track is provided. Parts 31 of the resistance track which extend in the direction transverse to the collector electrode 6 exhibit a comparatively high electrical resistance of, for example, from $10^8$ to $10^{11}$ ohms per cm, while parts 32 thereof which extend in the direction parallel to the collector electrode 6 exhibit a low electrical resistance. An auxiliary electrode of this kind can be simply and accurately manufactured, for example, by vapor deposition.

A particularly compact radiation detection device which, moreover, offers a high radiation detection efficiency is characterized in that the resistance layer also forms the entrance window of the radiation detection device. Because the window 2 and the space 21 are omitted, radiation 3 entering the ionization chamber detector 4 will have been attenuated to a small degree only.

Preferably, the end faces 16 and 15 of the high-voltage electrode 5 and the collector electrode 6, respectively, are electrically connected to the auxiliary electrode 19 by means of an electrically conductive adhesive (not shown in the Figures), so that vibrations are attenuated during operation.

What is claimed is:

1. A radiation detection device comprising:

a housing;

an entrance window in the housing; and an ionization chamber detector in the housing which comprises:

a high voltage electrode which is directed transverse to the entrance window;

a collector electrode which is substantially parallel to the high voltage electrode and spaced therefrom, such that radiation entering the housing through the entrance window passes between the electrodes;

an ionizible gas between the electrodes;

a high voltage source having two output terminals, one output terminal being electrically connected to the high voltage electrode;

current measuring means having two terminals, one terminal being electrically connected to the other output terminal of the high voltage source, the other terminal of the current measuring means being electrically connected to the collector electrode;

a flat auxiliary electrode situated adjacent and parallel to the entrance window and having a relatively high electrical resistance measured in the direction transverse to the collector electrode, said auxiliary electrode having two ends with one end adjacent the high voltage electrode and the other end adjacent but not directly electrically connected to the collector electrode, said output terminals of said high voltage source being electrically connected to the ends of the auxiliary electrode such that the electric field between the high voltage and collector electrodes is substantially homogeneous in the vicinity of the auxiliary electrode.

2. A radiation detection device as claimed in claim 1, wherein the high-voltage and collector electrodes are flat plates and wherein the high-voltage electrode has an end face which is adjacent to and electrically connected to the auxiliary electrode.

3. A radiation detection device as claimed in claim 2, wherein the electrical resistance of the auxiliary electrode, in a direction transverse to the collector electrode, is approximately between $10^8$ and $10^{11}$ ohms per centimeter.

4. A radiation detection device comprising:

a housing;

an entrance window in the housing; and an ionization chamber detector in the housing which comprises:

a high voltage electrode which is directed transverse to the entrance window;

a collector electrode which is substantially parallel to the high voltage electrode and spaced therefrom, such that radiation entering the housing through the entrance window passes between the electrodes;

an ionizible gas between the electrodes;

a high voltage source having two output terminals, one output terminal being electrically connected to the high voltage electrode;

current measuring means having two terminals, one terminal being electrically connected to the other output terminal of the high voltage source, the other terminal of the current measuring means being electrically connected to the collector electrode;

a flat auxiliary electrode situated adjacent and parallel to the entrance window and having two ends with one end adjacent the high voltage electrode and the other end adjacent but not directly electrically connected to the collector electrode, said output terminals of said high voltage source being electrically connected to the ends of the auxiliary electrode such that the electric field between the high voltage and collector electrodes is substantially homogeneous in the vicinity of the auxiliary electrode, said auxiliary electrode comprising a meander-shaped resistance track on a flat, electrically insulating support, said resistance track having a relatively high resistance in a direction transverse to the collector electrode and having a relatively low resistance in other directions.

5. A radiation detector device as claimed in claim 4, wherein the relatively high resistance portions of the resistance track has a resistance of approximately between $10^8$ and $10^{11}$ ohms per centimeter.

6. A radiation detection device as claimed in claim 3 or 5, wherein the auxiliary electrode also forms the entrance window.

* * * * *